US010626477B2

(12) United States Patent
Morino et al.

(10) Patent No.: US 10,626,477 B2
(45) Date of Patent: Apr. 21, 2020

(54) METHOD FOR MANUFACTURING HOT PRESS FORMED PART AND HOT PRESS FORMED PART

(71) Applicants: JFE STEEL CORPORATION, Chiyoda-ku, Tokyo (JP); TOYOTA JIDOSHA KABUSHIKI KAISHA, Toyota-shi, Aichi (JP)

(72) Inventors: Masaki Morino, Toyota (JP); Hideaki Kobiki, Tokyo (JP); Tatsuya Nakagaito, Tokyo (JP); Yuichi Tokita, Tokyo (JP); Toru Minote, Tokyo (JP); Yoshikiyo Tamai, Tokyo (JP)

(73) Assignees: JFE STEEL CORPORATION, Chiyoda-ku, Tokyo (JP); TOYOTA JIDOSHA KABUSHIKI KAISHA, Toyota-shi, Aichi (JP)

( * ) Notice: Subject to any disclaimer, the term of this patent is extended or adjusted under 35 U.S.C. 154(b) by 267 days.

(21) Appl. No.: 15/531,573

(22) PCT Filed: Sep. 8, 2015

(86) PCT No.: PCT/JP2015/004560
§ 371 (c)(1),
(2) Date: May 30, 2017

(87) PCT Pub. No.: WO2016/092720
PCT Pub. Date: Jun. 16, 2016

(65) Prior Publication Data

US 2018/0195144 A1 Jul. 12, 2018

(30) Foreign Application Priority Data

Dec. 12, 2014 (JP) ..... 2014-251381

(51) Int. Cl.
*C21D 9/50* (2006.01)
*B21D 22/20* (2006.01)
(Continued)

(52) U.S. Cl.
CPC ..... *C21D 9/50* (2013.01); *B21D 22/022* (2013.01); *B21D 22/20* (2013.01); *B21D 22/203* (2013.01);
(Continued)

(58) Field of Classification Search
CPC .... B21D 22/022; B21D 22/20; B21D 22/203; B21D 22/208; B21D 37/16; C21D 1/673;
(Continued)

(56) References Cited

U.S. PATENT DOCUMENTS

2001/0042393 A1 11/2001 Kefferstein et al.
2012/0164472 A1 6/2012 Kuhn et al.
(Continued)

FOREIGN PATENT DOCUMENTS

CN 101660093 A 3/2010
CN 102814403 A 12/2012
(Continued)

OTHER PUBLICATIONS

Dec. 27, 2018, Office Action issued by the State Intellectual Property Office in the corresponding Chinese Patent Application No. 201580067089.6 with English language concise statement of relevance.
(Continued)

*Primary Examiner* — Jenny R Wu
(74) *Attorney, Agent, or Firm* — Kenja IP Law PC

(57) ABSTRACT

A method for manufacturing a hot press formed part, includes: preparing a hot press forming object comprising a single-ply portion and a two-ply portion; heating the hot press forming object to a temperature range from an $Ac_3$
(Continued)

transformation temperature of a base steel sheet of the first coated steel sheet to 1000° C.; press forming the hot press forming object to obtain a formed body, the press forming being started upon temperatures of the single-ply portion and of the two-ply portion being no higher than solidification points of Zn—Ni coating layers of the first and second coated steel sheets and no lower than an $Ar_3$ transformation temperature of the base steel sheet of the first coated steel sheet; and quenching the formed body to thereby obtain a hot press formed part, in which the hot press forming object has a thickness ratio from 1.4 to 5.0.

16 Claims, 5 Drawing Sheets

(51) Int. Cl.

| | |
|---|---|
| ***B21D 37/16*** | (2006.01) |
| ***B21D 22/02*** | (2006.01) |
| ***C21D 1/673*** | (2006.01) |
| ***C21D 8/02*** | (2006.01) |
| ***C22C 18/00*** | (2006.01) |
| ***C23F 17/00*** | (2006.01) |
| ***C25D 3/22*** | (2006.01) |

(52) U.S. Cl.
CPC ..... *B21D 22/208* (2013.01); *B21D 37/16* (2013.01); *C21D 1/673* (2013.01); *C21D 8/0205* (2013.01); *C21D 8/0278* (2013.01); *C22C 18/00* (2013.01); *C23F 17/00* (2013.01); *C25D 3/22* (2013.01)

(58) Field of Classification Search
CPC ..... C21D 8/0205; C21D 8/0278; C21D 9/50; C22C 18/00; C23F 17/00; C25D 3/22
See application file for complete search history.

(56) References Cited

U.S. PATENT DOCUMENTS

| | | | | |
|---|---|---|---|---|
| 2012/0304448 | A1 | 12/2012 | Hartmann et al. | |
| 2012/0321903 | A1 | 12/2012 | Nakamaru et al. | |
| 2014/0147693 | A1 | 5/2014 | Yasuyama et al. | |
| 2014/0186655 | A1* | 7/2014 | Okita ..... | B21D 22/208 428/659 |

FOREIGN PATENT DOCUMENTS

| | | | | | |
|---|---|---|---|---|---|
| EP | 2684985 | A1 | | 1/2014 | |
| GB | 1490535 | A | | 11/1977 | |
| JP | 3663145 | B2 | | 6/2005 | |
| JP | 4325442 | B2 | | 9/2009 | |
| JP | 2011088484 | A | | 5/2011 | |
| JP | 2011246801 | A | | 12/2011 | |
| JP | 2012197505 | A | | 10/2012 | |
| JP | 2012197505 | A | * | 10/2012 | ..... B21D 22/022 |
| JP | 2013503254 | A | | 1/2013 | |
| JP | 2013091099 | A | | 5/2013 | |
| JP | 2013091099 | A | * | 5/2013 | ..... C23C 2/26 |
| JP | 2013184221 | A | | 9/2013 | |
| JP | 2014124673 | A | | 7/2014 | |
| JP | 2014124673 | A | * | 7/2014 | |
| WO | 2012036262 | A1 | | 3/2012 | |

OTHER PUBLICATIONS

Nov. 20, 2017, Extended European Search Report issued by the European Patent Office in the corresponding European Patent Application No. 15867156.0.
May 3, 2018, Office Action issued by the State Intellectual Property Office in the corresponding Chinese Patent Application No. 201580067089.6 with English language Search Report.
Nov. 24, 2015, International Search Report issued in the International Patent Application No. PCT/JP2015/004560.

* cited by examiner

METHOD FOR MANUFACTURING HOT PRESS FORMED PART AND HOT PRESS FORMED PART

TECHNICAL FIELD

This disclosure relates to methods for manufacturing hot press formed parts and hot press formed parts. More specifically, this disclosure relates to a method for manufacturing a hot press formed part by performing hot press forming on a hot press forming object that comprises a single-ply portion and a two-ply portion and that is obtainable by welding two coated steel sheets together in partially overlapping relationship, each having a Zn—Ni coating layer formed on a surface thereof, and a hot press formed part manufactured by the same.

BACKGROUND

In recent years, high-strengthening and sheet metal thinning of automotive parts have been required. As the steel sheets used for automotive parts have higher strength, press formability decreases, and it becomes more difficult to form the steel sheets into the desired part shape.

To address this issue, some conventional techniques propose performing hot press forming on a blank sheet heated to high temperature to have a desired shape using a tool of press forming, while quenching the blank sheet in the tool of press forming by utilizing heat releasing, to achieve high-strengthening of the hot press formed part. When elements are expressed in "%" herein, this refers to "mass %."

For example, GB1490535A (PTL 1) proposes a technique for achieving high-strengthening of a formed part by hot pressing a blank sheet (steel sheet) heated to an austenite single phase region and quenching the blank sheet in a tool of press forming simultaneously with the hot press forming.

In addition, JP2011088484A (PTL 2) describes a hot press forming method, in which hot press forming is performed such that a reinforcing steel sheet is overlapped on a steel sheet in need of reinforcement at a portion to be reinforced, in order to achieve high-strengthening of automotive parts by reinforcing the parts only at a specific portion to be reinforced in a more sufficient way while suppressing an increase in the weight of the automotive parts.

However, the techniques proposed in PTLs 1 and 2 have a problem in that heating of a steel sheet to a high temperature around 900° C. before press forming causes oxided scales (iron oxides) on the surface of the steel sheet, and such oxided scales come off from the surface during hot press forming and damages the tool of press forming or the surface of the hot press formed part. Such oxided scales remaining on the surface of the formed part also lead to poor appearance and degraded coating adhesion properties. Accordingly, oxided scales on the surface of the formed part are typically removed by a process such as pickling, shot blasting, or the like. Such processes, however, degrade productivity. Additionally, some parts are required to have high corrosion resistance, such as automotive suspension parts, structural parts of automotive bodies, and the like. However, hot press formed parts manufactured by the methods in PTLs 1 and 2 do not have rust preventive films such as coating layers, and are insufficient in corrosion resistance.

For these reasons, there has been demand for a hot press forming technique that can suppress formation of oxided scales upon heating prior to hot press forming and that can improve the corrosion resistance of hot press formed parts. To meet this demand, other conventional techniques propose coated steel sheets having films such as coating layers on their surfaces, and hot press forming methods using such coated steel sheets.

For example, JP3663145B (PTL 3) describes a method for manufacturing a hot press formed part having a Zn—Fe— or Zn—Fe—Al-based compound provided on a surface thereof and exhibiting good corrosion resistance by performing hot pressing on a coated steel sheet coated with Zn or a Zn-based alloy. However, in a hot press formed part manufactured by the method described in PTL 3, liquid metal embrittlement cracking may be caused by Zn in the coating layer, although formation of oxided scales is suppressed to some extent. Liquid metal embrittlement cracking causes the hot press formed part to suffer performance degradation, such as in fatigue strength, which is problematic.

Accordingly, JP2013184221A (PTL 4) proposes a method for manufacturing a hot press formed part by using a hot press forming object formed from overlapped coated steel sheets, each having a Zn or Zn alloy coating layer formed thereon, the method including: providing protrusions on overlapped coated steel sheets to form a gap of 0.03 mm to 2.0 mm between the overlapped coated steel sheets; and causing Zn present in a liquid phase state at the overlapping portion to evaporate into steam upon heating to suppress liquid metal embrittlement cracking.

In addition, JP2013091099A (PTL 5) describes a method for manufacturing a hot press formed part by using a coated steel sheet having a Zn—Fe-based coating layer formed thereon, in which to suppress liquid metal embrittlement cracking, a coated steel sheet is cooled to a temperature of no higher than the solidification point of the coating layer before subjection to press forming.

CITATION LIST

Patent Literature

PTL 1: GB1490535A
PTL 2: JP2011088484A
PTL 3: JP3663145B
PTL 4: JP2013184221A
PTL 5: JP2013091099A

SUMMARY

Technical Problem

According to the method in PTL 4, liquid metal embrittlement cracking can be suppressed when overlapping hot press forming is performed on a Zn or Zn alloy coated steel sheet. However, this method requires a step of forming projections beforehand in order to form a gap for evaporating the liquid phase upon heating. For this reason, there is concern that the productivity could decline or that the work environment could deteriorate due to the evaporated Zn.

Further, the method in PTL 5 requires cooling of a coated steel sheet to or below about 660° C., which is the solidification point of the Zn—Fe coating layer, before press forming. This raises a problem of an increase in costs associated with installation of cooling equipment separate from or inside the press machine, and a reduction in productivity due to an increase in cooling time. In addition, according to the method in PTL 5, when performing hot press forming using a hot press forming object formed from two overlapped coated steel sheets, even in the same cooling condition, the cooling rate varies in the two-ply and singlyply portions of the hot press forming object; the temperature of the single-ply portion is lower.

In particular, when the ratio of the thickness of the two-ply portion to the thickness of the single-ply portion is increased, the temperature difference between the two-ply portion and the single-ply portion becomes large, causing problems such as a reduction in hardenability and shape fixability due to excessive temperature decrease at the single-ply portion before hot press forming.

The issue of liquid metal embrittlement cracking also arises when hot press forming is performed on a hot press forming object formed from two overlapped coated steel sheets, each having a coating layer formed thereon. FIG. 8 illustrates the relationship between the thickness ratio, expressed as $t_2/t_1$, of thickness $t_2$ (millimeters) of a two-ply portion to thickness $t_1$ (millimeters) of a single-ply portion (hereinafter also referred to simply as "thickness ratio") and the temperature difference, expressed as T, between the two-ply portion and the single-ply portion during cooling (hereinafter also referred to simply as "temperature difference"), when a hot press forming object formed from partially overlapped coated steel sheets was heated throughout to the same temperature before being cooled. Here, since the decrease in hardenability and in shape fixability becomes significant when the temperature of the single-ply portion decreases below 600° C., the temperature difference T in FIG. 8 represents measurements at a point in time when the single-ply portion reached 600° C.

In this respect, if the method in PTL 5 is used, it is necessary to cool a hot press forming object to 660° C. or lower when using a typical Zn—Fe coated (12% Fe) steel sheet. As illustrated in FIG. 8, however, when the thickness ratio is 1.4 or more, the temperature difference is equal to or greater than 60° C., or the temperature of the two-ply portion is equal to or higher than 660° C. In this case, the temperature of the two-ply portion becomes equal to or higher than the solidification point of the Zn or Zn alloy coating layer, and liquid metal embrittlement cracking cannot be suppressed.

On the other hand, when hot press forming is performed on a hot press forming object formed from two overlapped coated steel sheets, it is desirable to increase the thickness ratio for increasing the strength without increasing the weight. The reason is that by increasing the thickness ratio, for example by overlapping a steel sheet having a large thickness on another steel sheet only at a portion to be reinforced for increased strength, it becomes possible to increase the efficiency of reinforcement at the portion to be reinforced, contributing to the weight reduction of the part as a whole.

As described above, however, in the case of performing hot press forming on a hot press forming object formed from two Zn or Zn alloy coated steel sheets, the temperature of the two-ply portion becomes high when the thickness ratio is 1.4 or more, which leads to melting of Zn, causing liquid metal embrittlement cracking to occur.

To address these issues, it could be helpful to provide a method for manufacturing a hot press formed part as disclosed herein that enables efficient reinforcement at a portion to be reinforced by increasing the thickness ratio, while avoiding deterioration of hardenability or shape fixability and preventing liquid metal embrittlement cracking, even when hot press forming is performed on a hot press forming object that is formed by joining two coated steel sheets in partially overlapping relationship, each having a Zn or Zn alloy coating layer formed thereon.

It could also be helpful to provide a hot press formed part manufactured by this method as disclosed herein.

Solution to Problem

1. A method for manufacturing a hot press formed part, comprising: preparing a hot press forming object comprising a single-ply portion and a two-ply portion by welding first and second coated steel sheets together in partially overlapping relationship, each of the first and second coated steel sheets having a Zn—Ni coating layer formed on a surface thereof; heating the hot press forming object to a temperature range from an $Ac_3$ transformation temperature of a base steel sheet of the first coated steel sheet to 1000° C.; press forming the hot press forming object to obtain a formed body, the press forming being started upon temperatures of the single-ply portion and of the two-ply portion being no higher than solidification points of the Zn—Ni coating layers of the first and second coated steel sheets and no lower than an $Ar_3$ transformation temperature of the base steel sheet of the first coated steel sheet; and quenching the formed body, while squeezing the formed body by a tool of press forming and holding at its press bottom dead center, to thereby obtain a hot press formed part, wherein the hot press forming object has a thickness ratio, expressed as $t_2/t_1$, from 1.4 to 5.0 where $t_1$ denotes a thickness in millimeters of the single-ply portion and $t_2$ denotes a thickness in millimeters of the two-ply portion.

2. The method for manufacturing a hot press formed part according to 1., wherein each of the Zn—Ni coating layers of the first and second coated steel sheets has an Ni content from 9 mass % to 25 mass %.

3. The method for manufacturing a hot press formed part according to 1. or 2., wherein the following relations are satisfied:

$$-0.35\times[\text{Ni }\%]_1^2+17.1\times[\text{Ni }\%]_1+72\geq 153\times\ln(t_2/t_1)+9.6;$$

and $$-0.35\times[\text{Ni }\%]_2^2+17.1\times[\text{Ni }\%]_2+72\geq 153\times\ln(t_2/t_1)+9.6,$$

where $[\text{Ni }\%]_1$ denotes the Ni content in mass % in the Zn—Ni coating layer of the first coated steel sheet and $[\text{Ni }\%]_2$ denotes the Ni content in mass % in the Zn—Ni coating layer of the second coated steel sheet.

4. A hot press formed part manufactured by the method as recited in any one of 1. to 3.

Advantageous Effect

According to the present disclosure, it is possible to manufacture high-strength, lightweight, and high-fatigue-strength hot press formed parts that are free from liquid metal embrittlement cracking even when performing hot press forming on hot press forming objects having a high thickness ratio. Additionally, the present disclosure enables more efficient reinforcement at portions to be reinforced, because it may improve the thickness ratio of the hot press forming object compared to conventional techniques, offering a greater degree of freedom in design.

Moreover, liquid metal embrittlement cracking, which would otherwise occur in hot press forming objects after heating, can be suppressed without using special cooling equipment, which is also advantageous in terms of manufacturing cost and productivity.

DETAILED DESCRIPTION

Figure 1:
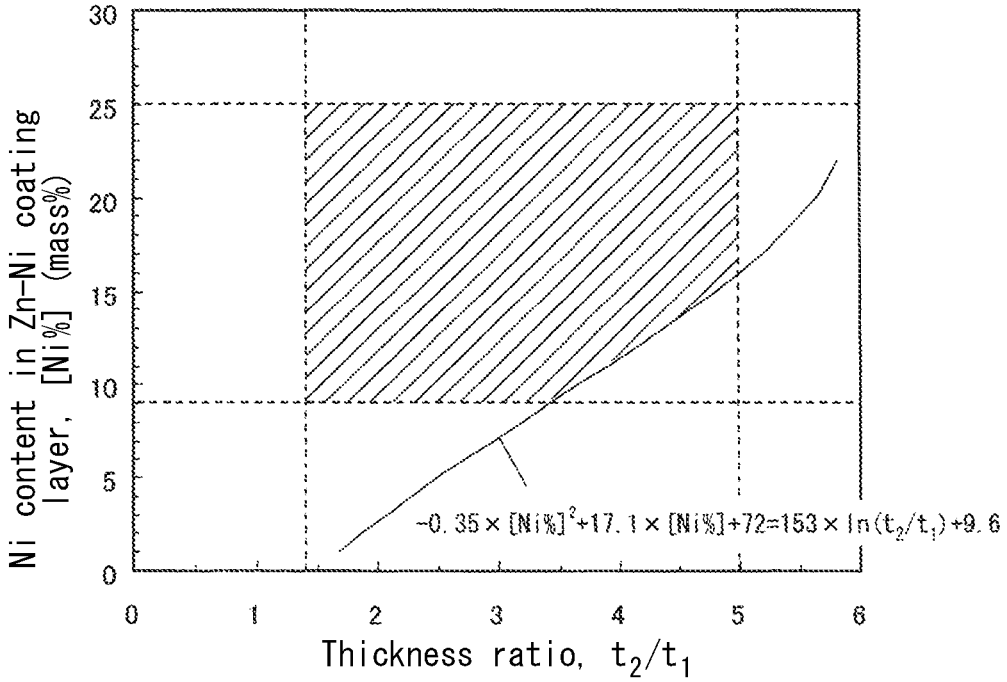
FIG. 1 illustrates the relationship between the thickness ratio and the Ni content in the Zn—Ni coating layer.

In an embodiment of the present disclosure, a method for manufacturing a hot press formed part comprises: (i) preparing a hot press forming object comprising a single-ply portion and a two-ply portion by welding first and second coated steel sheets together in partially overlapping relationship, each of the first and second coated steel sheets having a Zn—Ni coating layer formed on a surface thereof; (ii) heating the hot press forming object to a temperature range from an $Ac_3$ transformation temperature of a base steel sheet of the first coated steel sheet to 1000° C.; (iii) press forming the hot press forming object to obtain a formed body, the press forming being started upon temperatures of the single-ply portion and of the two-ply portion being no higher than solidification points of the Zn—Ni coating layers of the first and second coated steel sheets and no lower than an $Ar_3$ transformation temperature of the base steel sheet of the first coated steel sheet; and (iv) quenching the formed body, while squeezing the formed body by a tool of press forming and holding at its press bottom dead center, to thereby obtain a hot press formed part.

The following provides details of the hot press forming object prepared in (i), and of (ii), (iii), and (iv).

<Hot Press Forming Object>

The hot press forming object prepared in (i) uses a coated steel sheet having a Zn—Ni coating layer formed on the surface of a base steel sheet. First, the coated steel sheet is described below.

A Zn—Ni alloy has a very high solidification point compared to ordinary Zn or Zn alloy coating layers, such as pure Zn coating layers or Zn—Fe alloy coating layers, as can be seen from the γ-phase, which appears in the Zn—Ni alloy phase equilibrium diagram and improves corrosion resistance, having a solidification point of 800° C. or higher. For this reason, a Zn—Ni coated steel sheet was used as the material of the hot press forming object. It is also possible to use two steel sheets, each having Zn—Ni coating applied only on one side.

The base steel sheet is not particularly limited, and, for example, a hot-rolled steel sheet (pickled steel sheet) having a predetermined chemical composition or a cold-rolled steel sheet obtainable by cold rolling a hot-rolled steel sheet (pickled steel sheet) may be used. There is also no particular restriction on the manufacturing conditions on the base steel sheet.

The method for forming a Zn—Ni coating layer on a surface of the base steel sheet includes, for example, after degreasing and pickling a base steel sheet, subjecting the base steel sheet to electrogalvanizing in a plating bath containing nickel sulfate hexahydrate at a concentration of 100 g/L to 400 g/L and zinc sulfate heptahydrate at a concentration of 10 g/L to 400 g/L, at a pH of 1.0 to 3.0 and a bath temperature of 30° C. to 70° C., with a current density of 10 $A/dm^2$ to 150 $A/dm^2$. When a cold-rolled steel sheet is used as the base steel sheet, the cold-rolled steel sheet may be subjected to annealing treatment before subjection to the degreasing and pickling.

The Ni content in the Zn—Ni coating layer is preferably 9 mass % or more. The Ni content in the Zn—Ni coating layer is preferably 25 mass % or less. For example, by appropriately adjusting the concentration of zinc sulfate heptahydrate and the current density within the above-identified ranges, it is possible to obtain a desired Ni content (ranging from 9 mass % to 25 mass %).

In the case of forming a Zn—Ni coating layer on a surface of the base steel sheet by electrogalvanizing, a γ-phase having a crystal structure of either $Ni_2Zn_{11}$, $NiZn_3$, or $Ni_5Zn_{21}$ is formed when the Ni content in the coating layer is set in a range from 9 mass % to 25 mass %. This γ-phase has a high melting point, and is thus advantageous in suppressing the evaporation of the coating layer, which is a concern during (ii). The γ phase is also advantageous in suppressing liquid metal embrittlement cracking, which is problematic if it occurs during high-temperature hot press forming. In addition, the γ-phase has a sacrificial protection effect on steel and is also effective for improving corrosion resistance.

The coating weight is preferably 10 $g/m^2$ or higher per side. The coating weight is preferably 90 $g/m^2$ or lower per side. The coating weight can be set as desired by adjusting the energizing time.

The method for forming a Zn—Ni coating layer on a surface of the base steel sheet is not particularly limited, and any methods such as hot-dip galvanizing and electrogalvanizing may be used. When a hot-rolled steel sheet (pickled steel sheet) is used as the base steel sheet, the hot-rolled steel sheet (pickled steel sheet) may be subjected to Zn—Ni coating treatment to obtain a coated steel sheet. Alternatively, when a cold-rolled steel sheet is used as the base steel sheet, a cold-rolled steel sheet may be subjected to Zn—Ni coating treatment either directly after subjection to the cold rolling, or after subjection to annealing treatment following the cold rolling, to obtain a coated steel sheet.

The coated steel sheet thus obtained is used to produce a hot press forming object. Specifically, a first coated steel sheet as a base material and a second coated steel sheet as a reinforcing material are blanked with predetermined dimensions, then the second coated steel sheet is partially overlapped on the first coated steel sheet, and these coated steel sheets are joined by spot welding to produce a hot press forming object comprising a two-ply portion and a single-ply portion. The single-ply portion is formed from the first coated steel sheet, and its thickness $t_1$ (millimeters) is the same as that of the first coated steel sheet. Thickness $t_2$ (millimeters) of the two-ply portion is the total thickness of the first and second coated steel sheets.

When performing hot press forming on such a hot press forming object, it is necessary to cool the hot press forming object to a predetermined temperature after heating before the start of the press forming. However, the cooling rate varies in the two-ply and single-ply portions of the hot press forming object even under the same cooling condition; the temperature of the single-ply portion is lower. In addition, as the thickness ratio $t_2/t_1$ becomes large, the temperature difference T between the two-ply portion and the single-ply portion increases.

On the other hand, to prevent a reduction in hardenability or in shape fixability of the single-ply portion formed from the first coated steel sheet, it is necessary to set the press forming start temperature for the hot press forming object at or above an $Ar_3$ transformation temperature of the base steel sheet of the first coated steel sheet (hereinafter, where reference is made simply to "the $Ar_3$ transformation temperature", this refers to the $Ar_3$ transformation temperature of the base steel sheet of the first coated steel sheet). However, when the temperature of the single-ply portion is set at or above the $Ar_3$ transformation temperature, and particularly when the thickness ratio is large, the temperature of the two-ply portion becomes equal to or higher than the solidification point of the Zn—Ni coating layer, which causes the coating layer of the coated steel sheet to melt and consequently liquid metal embrittlement cracking to occur.

Therefore, the thickness ratio of the hot press forming object needs to be 5.0 or less. The thickness ratio is preferably 4.0 or less, and more preferably 3.0 or less. Further, from the perspective of efficiently reinforcing a portion to be reinforced without a significant increase in weight, the thickness ratio of the hot press forming object needs to be 1.4 or more. The thickness ratio is preferably 1.6 or more, and more preferably 1.8 or more.

Here, the upper limit for the thickness ratio of the hot press forming object is determined by the solidification points of the Zn—Ni coating layers and the temperature difference T between the two-ply portion and the single-ply portion of the hot press forming object.

As described above, to produce a γ-phase having a high solidification point and exhibiting excellent corrosion resistance, the upper limit for the Ni content is set to 25 mass %, in which case the solidification point of the Zn—Ni alloy is about 880° C.

On the other hand, to prevent a reduction in hardenability or in shape fixability during press forming, it is necessary to set the press forming start temperature for the hot press forming object no lower than the $Ar_3$ transformation temperature (approximately 600° C. or higher).

Accordingly, up to 280° C. may be allowed as the temperature difference between the two-ply portion and the single-ply portion of the hot press forming object. To meet the requirements for this temperature difference, the upper limit for the thickness ratio is set to 5.0.

Furthermore, the solidification point of each Zn—Ni coating layer varies with the Ni content in the coating layer, and the thickness ratio allowable in the hot press forming object varies according to the difference in the solidification point. Therefore, it is preferable that the thickness ratio and the Ni content in the Zn—Ni coating layer satisfy the relation given by:

$$-0.35\times[\text{Ni }\%]^2+17.1\times[\text{Ni }\%]+72\geq 153\times\ln(t_2/t_1)+9.6 \quad (1)$$

where [Ni %] denotes the Ni content (mass %) in the Zn—Ni coating layer, $t_2$ denotes the thickness (millimeters) of the two-ply portion, and $t_1$ denotes the thickness (millimeters) of the single-ply portion.

In a situation in which the Zn—Ni coating layers of the first and second coated steel sheets have different Ni contents, it is preferable that the following relations are satisfied:

$$-0.35\times[\text{Ni }\%]_1^2+17.1\times[\text{Ni }\%]_1+72\geq 153\times\ln(t_2/t_1)+9.6 \quad (1a)$$

$$-0.35\times[\text{Ni }\%]_2^2+17.1\times[\text{Ni }\%]_2+72\geq 153\times\ln(t_2/t_1)+9.6 \quad (1b)$$

where $[\text{Ni }\%]_1$ denotes the Ni content in mass % of the Zn—Ni coating layer of the first coated steel sheet and $[\text{Ni }\%]_2$ denotes the Ni content in mass % in the Zn—Ni coating layer of the second coated steel sheet.

FIG. 1 illustrates the relationship between the thickness ratio $t_2/t_1$ and the Ni content in the Zn—Ni coating layer [Ni %]. In the figure, the hatched portion shows a range that satisfies expression (1) when the thickness ratio and the Ni content in the Zn—Ni coating layer are in a predetermined range.

The derivation of expression (1) follows.

Figure 2:
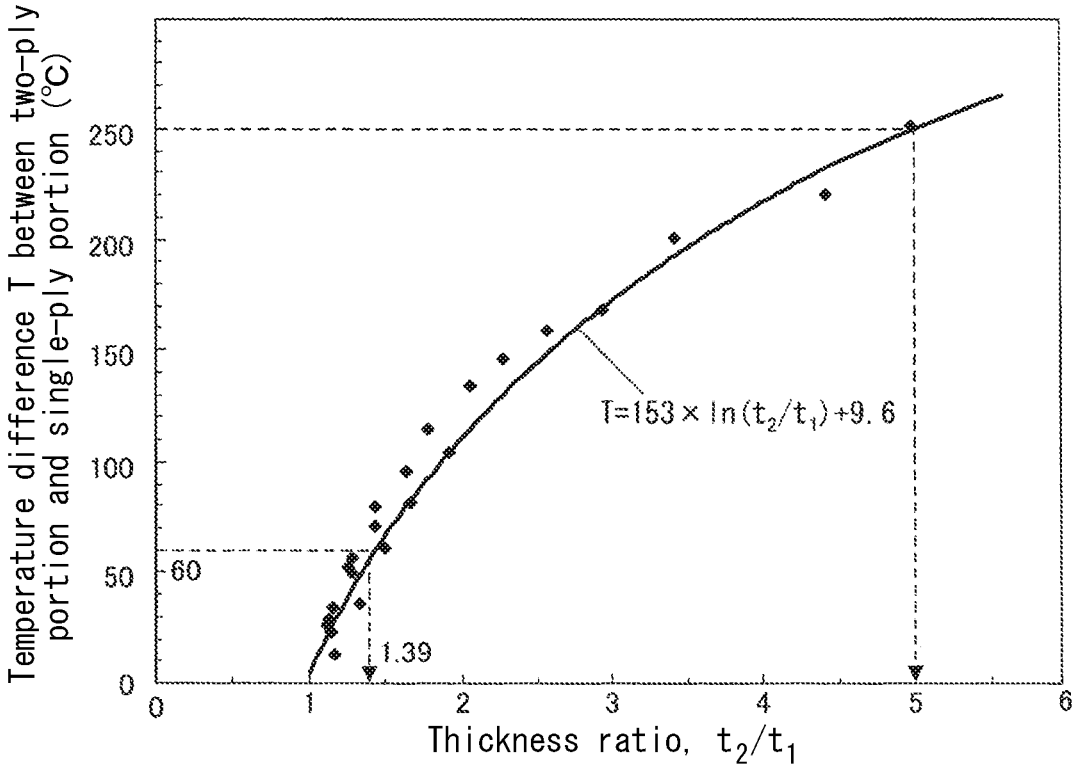
FIG. 2 illustrates the relationship between the thickness ratio and the temperature difference between a two-ply portion and a single-ply portion.

First, we investigated a relationship between the thickness ratio $t_2/t_1$ and the temperature difference T between two-ply portions and single-ply portions. The results are presented in FIG. 2. It is noted that the temperature difference T between the two-ply portion and the single-ply portion refers to the temperature difference between the two-ply portion and the single-ply portion at a point in time when the temperature of the single-ply portion reached 600° C. after the hot press forming object being heated throughout to the same temperature and air-cooled. It can be seen from FIG. 2 that the temperature difference T increases with increasing thickness ratio $t_2/t_1$. These results yielded a regression equation given by expression (2) for the thickness ratio $t_2/t_1$ and the temperature difference T:

$$T=153\times\ln(t_2/t_1)+9.6 \quad (2)$$

Figure 3:
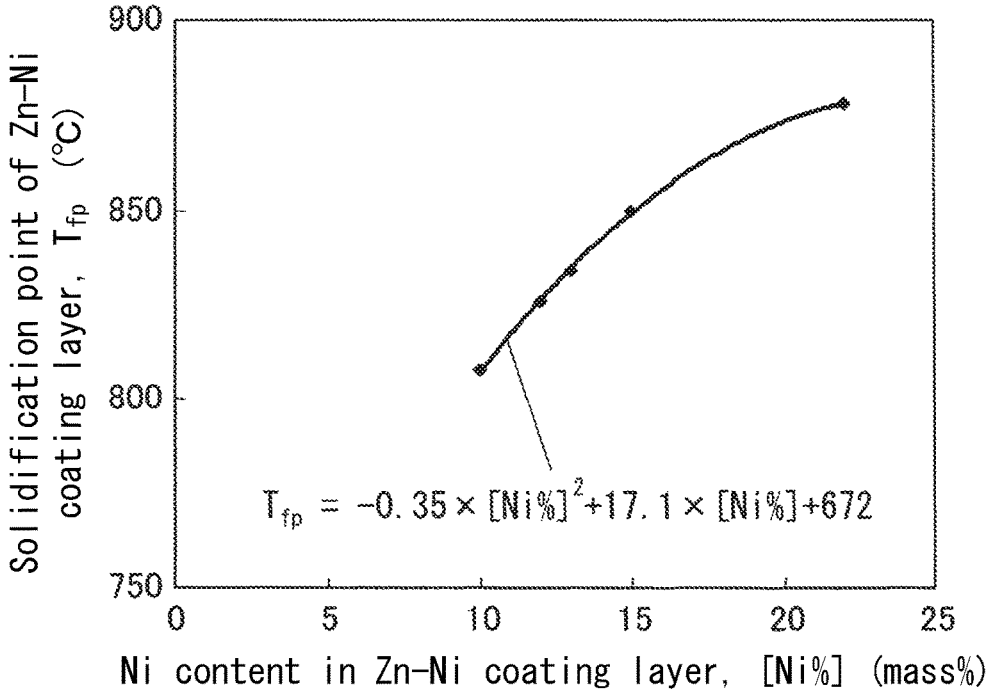
FIG. 3 illustrates the relationship between the Ni content in each Zn—Ni coating layer and the solidification point of the coating layer.

We then investigated a relationship between the Ni content in each Zn—Ni coating layer, expressed as [Ni %], and the solidification point of the Zn—Ni coating layer, expressed as $T_{fp}$. The relationship is presented in FIG. 3. It can be seen from FIG. 3 that the solidification point of each Zn—Ni coating layer rises with increasing Ni content. Additionally, these results yielded a regression equation between [Ni %] (the Ni content in a Zn—Ni coating layer) and $T_{fp}$ (the solidification point of the Zn—Ni coating layer) given by:

$$T_{fp}=-0.35\times[\text{Ni }\%]^2+17.1\times[\text{Ni }\%]+672 \quad (3)$$

One condition required to prevent liquid metal embrittlement cracking during the hot press forming of the hot press forming object as described above is to set the temperature of the two-ply portion at the start of press forming no higher than the solidification point of the Zn—Ni coating layer. As described above, the temperature difference T between the two-ply portion and the single-ply portion in expression (2) represents the temperature difference between the two-ply portion and the single-ply portion at a point in time when the temperature of the single-ply portion reached 600° C. Accordingly, it suffices for a sum of 600° C.+ the temperature difference T between the two-ply portion and the single-ply portion defined by equation (2) not to exceed the solidification point of the Zn—Ni coating layer, as presented below:

$$T_{fp}\geq 600+153\times\ln(t_2/t_1)+9.6 \quad (4)$$

By substitution of the regression equation (3) for the solidification point $T_{fp}$ of the coating layer into expression (4), equation (1) is derived.

If the relation of expression (1) is satisfied, it is possible to more effectively avoid liquid metal embrittlement cracking at the two-ply portion.

<Heating>

In (ii), the hot press forming object prepared in (i) is heated to a predetermined heating temperature in a heating furnace in air atmosphere, for example, and is retained for a predetermined holding time. At this time, the hot press forming object is heated to a temperature range from the $Ac_3$ transformation temperature to 1000° C. The holding time is not particularly limited, yet is preferably set in a range from 10 s to 60 s.

When the base steel sheets of the first and second coated steel sheets have different $Ac_3$ transformation temperatures, it is preferable to set the heating temperature for the hot press forming object no lower than the $Ac_3$ transformation temperature of the base steel sheet of the first coated steel sheet and no lower than the $Ac_3$ transformation temperature of the base steel sheet of the second coated steel sheet.

If the heating temperature for the hot press forming object is below the $Ac_3$ transformation temperature, an appropriate amount of austenite cannot be obtained during heating and ferrite will form during press forming, which makes it difficult to guarantee adequate strength or favorable shape fixability after the hot press forming. On the other hand, if the heating temperature for the hot press forming object exceeds 1000° C., the coating layer evaporates or excessive oxides form in the surface layer part, leading to a deterioration in oxidation resistance or corrosion resistance of the hot press formed part. Therefore, the heating temperature for the hot press forming object is set in a range from the $Ac_3$ transformation temperature to 1000° C. The heating temperature is preferably no lower than the temperature [the $Ac_3$ transformation temperature+30° C.]. The heating temperature is preferably no higher than 950° C.

The method for heating the hot press forming object is not particularly limited, and any methods may be used, such as heating in an electric furnace, induction heating furnace, direct current furnace, gas heating furnace, or infrared heating furnace.

<Press Forming>

After being heated in (ii), the hot press forming object is subjected to press forming to obtain a formed body. The press forming is started upon temperatures of the single-ply portion and of the two-ply portion being no higher than solidification points of the Zn—Ni coating layers of the first and second coated steel sheets and no lower than the $Ar_3$ transformation temperature of the base steel sheet of the first coated steel sheet.

Setting the press forming start temperature no lower than the $Ar_3$ transformation temperature can prevent a deterioration in hardenability or shape fixability. In addition, setting the press forming start temperature no higher than the solidification points of the Zn—Ni coating layers can prevent occurrence of liquid metal embrittlement cracking.

The lower limit for the press forming start temperature is preferably no lower than [the $Ar_3$ transformation temperature+30° C.], and the upper limit is preferably no higher than [the solidification points of the Zn—Ni coating layers of the first and second coated steel sheets−30° C.].

Additionally, the press forming is carried out by crash forming which does not use a blank holder or deep drawing which uses a blank holder. The tool of press forming has round portions at the punch shoulder and at the die shoulder, for example, and the clearance between the die and the punch is adjusted in accordance with the position at which the two-ply and single-ply portions of the hot press forming object abut each other in the tool of press forming.

<Quenching>

In the quenching, the formed body obtainable by the above press forming is quenched while being squeezed by the tool of press forming and held at its press bottom dead center, to thereby obtain a hot press formed part. To quench the formed body using the tool of press forming following the press forming, it is preferable to release the heat from the formed body after subjection to the press forming by holding for a predetermined time (3 seconds to 60 seconds) at the press bottom dead center.

Upon completion of the quenching, the hot press formed part thus obtained is released from the tool of press forming.

Examples

Next, the effects of the method for manufacturing a hot press formed part according to the disclosure are described based on examples.

In the disclosed examples, cold-rolled steel sheets, each having a chemical composition containing 0.22 mass % of C, 0.15 mass % of Si, 1.43 mass % of Mn, 0.02 mass % of P, 0.004 mass % of S, 0.03 mass % of Al, and 0.004 mass % of N (and the balance being Fe and incidental impurities), were used as base steel sheets ($Ac_3$ transformation temperature: 805° C.), and either a Zn—Ni coating layer, a pure Zn coating layer, or a Zn—Fe coating layer was formed on a surface of each cold-rolled steel sheet.

In this case, the $Ac_3$ transformation temperature was calculated by the following expression (see William. Leslie, "*The Physical Metallurgy of Steels*", translated by Hiroshi Kumai and Tatsuhiko Noda, translation supervised by Shigeyasu Koda, Maruzen Co., Ltd., 1985, p. 273):

$$Ac_3(°\ C.)=910-203\times[C]^{0.5}+44.7\times[Si]-30\times[Mn]+700\times[P]+400\times[Al]$$

where [C], [Si], [Mn], [P], and [Al] are the contents (mass %) of the respective elements (C, Si, Mn, P, and Al) enclosed in the brackets.

Each coating layer was formed under the following conditions.

<Zn—Ni Coating Layer>

Some of the cold-rolled steel sheets were passed through a continuous annealing line, heated to a temperature range from 800° C. to 900° C. at a heating rate of 10° C./s, retained in this temperature range for 10 s to 120 s, and then cooled to a temperature range of 500° C. or lower at a cooling rate of 15° C./s. Then, these cold-rolled steel sheets were subjected to electrogalvanizing treatment in a plating bath containing nickel sulfate hexahydrate at a concentration of 100 g/L to 400 g/L and zinc sulfate heptahydrate at a concentration of 10 g/L to 400 g/L, at a pH of 1.0 to 3.0 and a bath temperature of 30° C. to 70° C., with a current density of 10 A/dm$^2$ to 150 A/dm$^2$, whereby Zn—Ni coating layers were formed with predetermined Ni content and coating weight. The Ni content in each Zn—Ni coating layer was set to a predetermined content by adjusting the concentration of zinc sulfate heptahydrate and the current density. The coating weight of each coating layer was set to a predetermined coating weight by adjusting the energizing time.

<Pure Zn Coating Layer>

Some of the cold-rolled steel sheets were passed through a continuous hot-dip galvanizing line, heated to a temperature range from 800° C. to 900° C. at a heating rate of 10° C./s, retained in this temperature range for 10 s to 120 s, then cooled to a temperature range from 460° C. to 500° C. at a cooling rate of 15° C./s, and dipped into a galvanizing bath at 450° C., whereby Zn coating layers were formed. The coating weight of each Zn coating layer was adjusted to a predetermined coating weight using a gas wiping method.

<Zn—Fe Coating Layer>

The other cold-rolled steel sheets were passed through a continuous hot-dip galvanizing line, heated to a temperature range from 800° C. to 900° C. at a heating rate of 10° C./s, retained in this temperature range for 10 s to 120 s, then cooled to a temperature range from 460° C. to 500° C. at a cooling rate of 15° C./s, and dipped into a galvanizing bath at 450° C., whereby Zn coating layers were formed. The coating weight of each Zn coating layer was adjusted to a predetermined coating weight using a gas wiping method. As soon as the Zn coating layer was adjusted to a predetermined coating weight using the gas wiping method, the corresponding cold-rolled steel sheet was heated to a temperature range from 500° C. to 550° C. and retained for 5 s to 60 s in an alloying furnace to form a Zn—Fe coating layer. The Fe content in each coating layer was set to a predetermined content by changing the heating temperature in the alloying furnace and the holding time at the heating temperature within the above-mentioned ranges.

Figure 4:
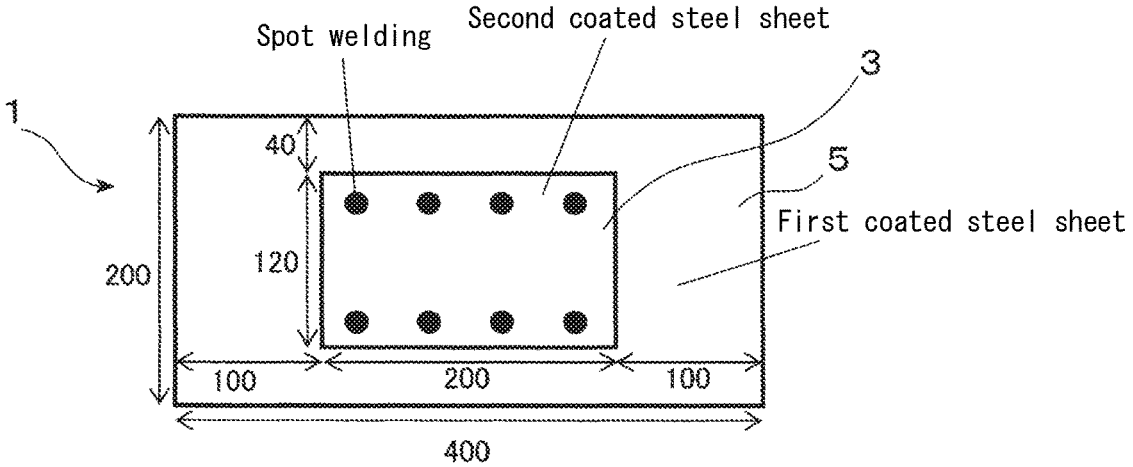
FIG. 4 is a schematic view of a hot press forming object according to an embodiment of the present disclosure.

From each of the coated steel sheets thus obtained (Steel A to Steel I), a first coated steel sheet (200 mm×400 mm) as a base material and a second coated steel sheet (120 mm×200 mm) as a reinforcing material were punched out. Then, as illustrated in FIG. 4, each second coated steel sheet was partially overlapped on the corresponding first coated steel sheet and joined by spot welding to obtain a hot press forming object 1 comprising a two-ply portion 3 and a single-ply portion 5.

Table 1 presents the types, coating weights, solidification points, $Ar_3$ transformation temperatures, and thicknesses of the coating layers of the coated steel sheets used in the examples (Steel A to Steel I). In this case, measurement was made of the $Ar_3$ transformation temperature of Steel A to Steel I as follows. Samples for thermal expansion measurement were collected from the base steel sheets of Steel A to Steel I and heated for austenization to 950° C. The $Ar_3$ transformation temperature was then measured for each sample. Air cooling was carried out by allowing each sample to cool in the air.

TABLE 1

| | Coating layer | | | $Ar_3$ | |
|---|---|---|---|---|---|
| Steel ID | Type | Coating weight ($g/m^2$) | Solidification point (° C.) | transformation temperature (° C.) | Thickness (mm) |
| A | Zn—12% Ni | 45 | 827 | 610 | 1.8 |
| B | Zn—10% Ni | 65 | 808 | 630 | 2.3 |
| C | Zn—15% Ni | 30 | 850 | 580 | 1.2 |
| D | Zn—22% Ni | 22 | 879 | 660 | 3.9 |
| E | Zn—13% Ni | 25 | 835 | 670 | 5.0 |
| F | Zn | 40 | 419.5 | 610 | 1.8 |
| G | | 40 | 419.5 | 630 | 2.3 |
| H | Zn—11% Fe | 45 | 665 | 610 | 1.8 |
| I | | 45 | 665 | 630 | 2.3 |

Figure 5:
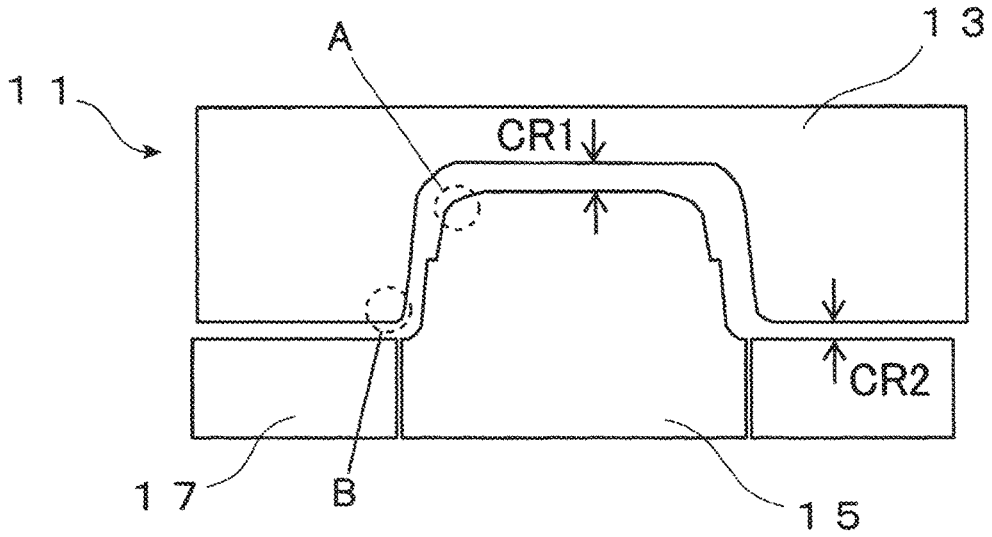
FIG. 5 is a schematic view of a tool of press forming according to an embodiment of the present disclosure.

Then, each hot press forming object 1 was heated in an electric furnace in air atmosphere under the conditions in Table 2. Subsequently, each hot press forming object 1 was set in a tool of press forming 11 (in an open position) as illustrated in FIG. 5, and press forming was performed at the press forming start temperatures listed in Table 2 to obtain formed bodies. The press forming was carried out by crash forming in which the punch 15 was pushed against and into the die 13 without using the blank holder, which was thus lowered. After being quenched in the tool of press forming 11 while being held at the press bottom dead center for 30 s, each formed body was released from the tool of press forming 11, and as a result a hot press formed part with a hat cross section shape as illustrated in FIG. 6 was obtained.

As illustrated in FIG. 5, the tool of press forming 11 has a cross section shape such that point A (a round portion of the punch shoulder) and point B (a round portion of the die shoulder) both have a radius of curvature R of 5 mm. Clearances CR1 and CR2 between the die 13 and the punch 15 were adjusted in the tool of press forming to match the thickness of the two-ply portion of the hot press forming object and the thickness of the single-ply portion, respectively.

Figure 6:
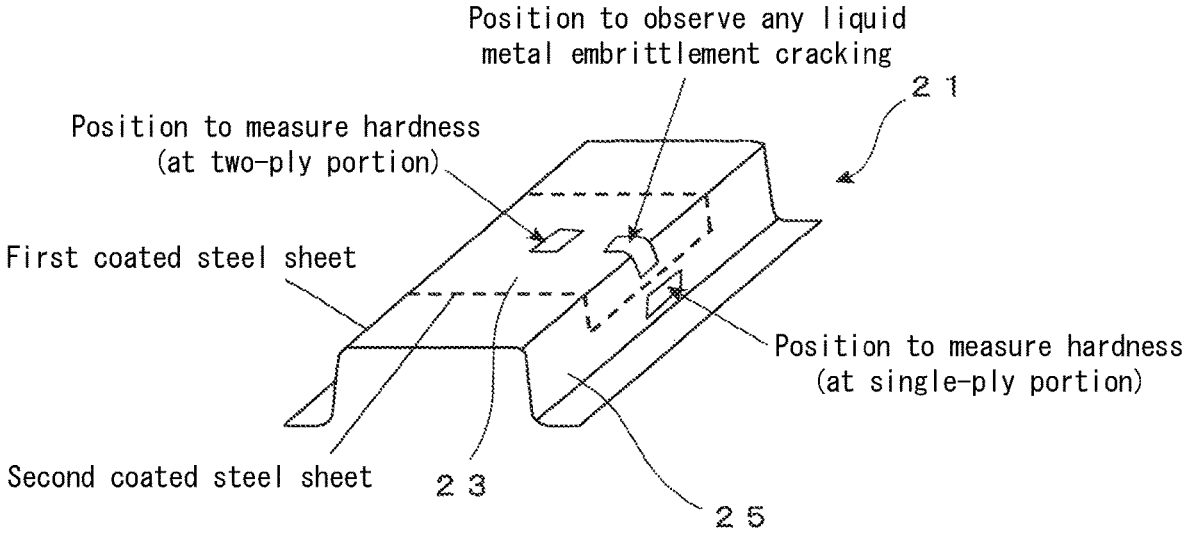
FIG. 6 is a schematic view of a hot press formed part manufactured in an example.

In each hot press formed part thus prepared, the presence or absence of liquid metal embrittlement cracking was judged by observing a cross section of a sample cut out from the two-ply portion (at a portion contacting the R portion of the punch shoulder) as illustrated in FIG. 6.

As illustrated in FIG. 6, samples were further collected from the surface of a top portion 23 of each hot press formed part 21, which is located at the two-ply portion, and from a wall portion 25, which is located at the single-ply portion, respectively, and the hardness was measured with a Vickers hardness meter. The hardness of each sample was determined by averaging the results obtained by measurement at intervals of 0.1 mm along the thickness direction of each sample under a load of 2.94 N. In this case, the targeted hardness was 400 Hv or more.

Figure 7:
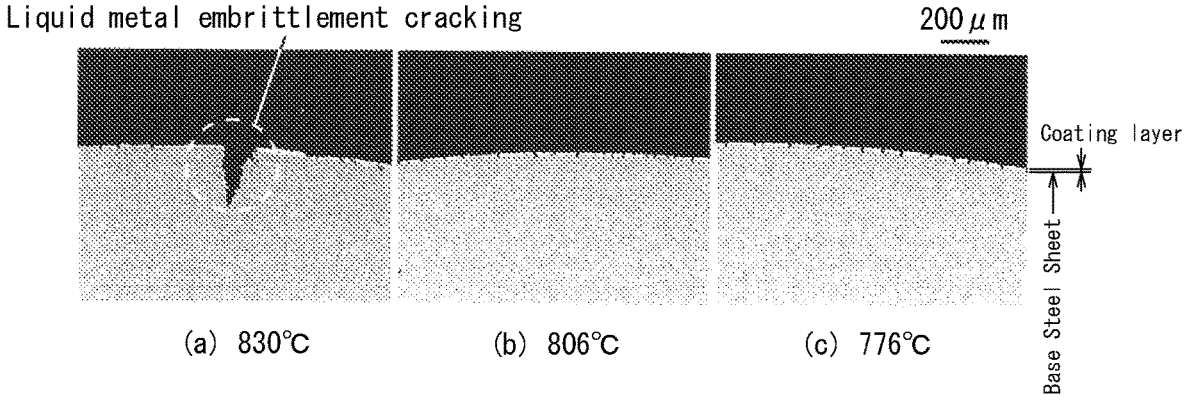
FIG. 7 is a micrograph for ascertaining the presence or absence of liquid metal embrittlement cracking in a hot press formed part.
Figure 8:
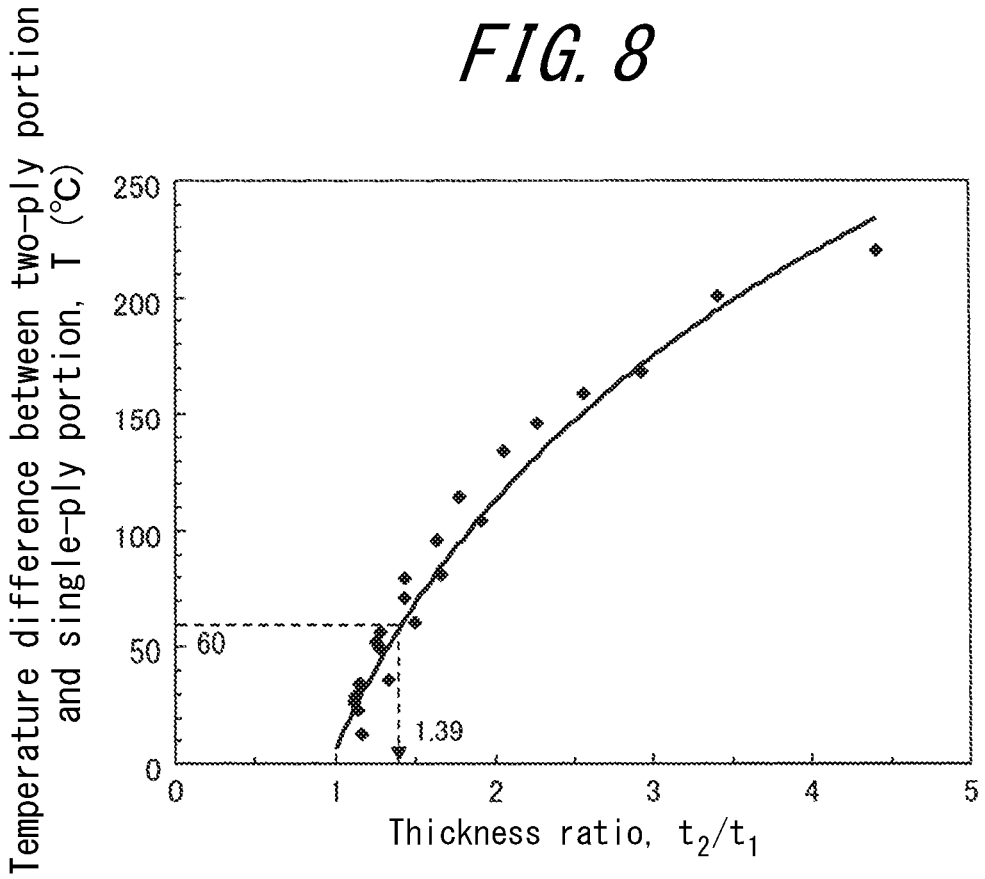
FIG. 8 illustrates the relationship between the thickness ratio and the temperature difference between two-ply and single-ply portions.

FIG. 7 presents micrographs that were taken for observing the presence or absence of liquid metal embrittlement cracking in hot press formed parts prepared by performing hot press forming at different press forming start temperatures on hot press forming objects, whose first and second coated steel sheets were both formed from Steel A (coating layer's solidification point: 827° C.). For hot press formed parts for which the press forming start temperature at the two-ply portion was set to 776° C. ((c) in FIG. 7) or 806° C. ((b) in FIG. 7), liquid metal embrittlement cracking did not occur. In contrast, for the other hot press formed part for which the press forming start temperature at the two-ply portion was set to 830° C. ((a) in FIG. 7), which is higher than the solidification point of the Zn—Ni coating layer, liquid metal embrittlement cracking occurred from the surface of the hot press formed part toward the inside of the base steel sheet.

Table 2 also presents the types of coated steel sheets used for the hot press forming objects, thickness ratios $t_2/t_1$, heating conditions for the hot press forming objects, press forming start temperatures, presence or absence of liquid metal embrittlement cracking, and hardness measurements. The thickness ratio $t_2/t_1$ was calculated as [the thickness of the first coated steel sheet+ the thickness of the second coated steel sheet]/[the thickness of the first coated steel sheet].

TABLE 2

| First coated steel sheet | Second coated steel sheet | Thickness ratio $t_2/t_1$ | Heating conditions for hot press forming object: Heating temp. (° C.) | Heating conditions for hot press forming object: Holding time (s) | Press forming start temp. (° C.): Single-ply portion | Press forming start temp. (° C.): Two-ply portion | Evaluation results: Liquid metal embrittlement cracking | Evaluation results: Hardness (Hv): Single-ply portion | Evaluation results: Hardness (Hv): Two-ply portion | Remarks |
|---|---|---|---|---|---|---|---|---|---|---|
| Steel A | Steel A | 2.00 | 900 | 10 | 680 | 759 | Not occurred | 485 | 473 | Example 1 |
| | | | 870 | 20 | 630 | 727 | Not occurred | 475 | 462 | Example 2 |
| | | | 890 | 15 | 700 | 772 | Not occurred | 488 | 472 | Example 3 |
| | | | 910 | 5 | 780 | 830 | Occurred | 485 | 471 | Comparative Example 1 |
| | | | 900 | 30 | 570 | 689 | Not occurred | 365 | 461 | Comparative Example 2 |
| Steel A | Steel B | 2.28 | 900 | 15 | 670 | 766 | Not occurred | 481 | 475 | Example 4 |
| Steel B | Steel C | 1.52 | 850 | 20 | 640 | 695 | Not occurred | 473 | 468 | Example 5 |
| Steel C | Steel B | 2.92 | 900 | 10 | 630 | 776 | Not occurred | 483 | 471 | Example 6 |
| Steel C | Steel D | 4.25 | 910 | 60 | 620 | 826 | Not occurred | 462 | 443 | Example 7 |
| Steel A | Steel E | 3.78 | 920 | 40 | 620 | 806 | Not occurred | 476 | 451 | Example 8 |
| Steel C | Steel E | 5.17 | 920 | 60 | 620 | 854 | Occurred | 469 | 435 | Comparative Example 3 |
| Steel F | Steel F | 2.00 | 880 | 30 | 620 | 721 | Occurred | 462 | 465 | Comparative Example 4 |
| Steel F | Steel G | 2.28 | 900 | 10 | 650 | 755 | Occurred | 478 | 472 | Comparative Example 5 |
| Steel H | Steel H | 2.00 | 900 | 15 | 675 | 756 | Occurred | 481 | 475 | Comparative Example 6 |
| Steel H | Steel I | 2.28 | 910 | 10 | 640 | 749 | Occurred | 469 | 463 | Comparative Example 7 |
| Steel F | Steel F | 2.00 | 900 | 30 | 450 | 639 | Occurred | 255 | 420 | Comparative Example 8 |
| Steel H | Steel H | 2.00 | 880 | 10 | 530 | 685 | Occurred | 278 | 443 | Comparative Example 9 |

It can be seen from Table 2 that for Examples 1 to 8, the thickness ratio, the type of coating layer (Zn—Ni coating layer), the heating temperature for the hot press forming object, and the press forming start temperature are all within the appropriate ranges, and liquid metal embrittlement cracking did not occur in the hot press formed parts, which exhibited sufficient hardness.

For Examples 1 to 3, Steel A having an Ni content in the Zn—Ni coating layer of 12 mass % was used for both the first and second coated steel sheets, and solving expressions (1a) and (1b) both yield $t_2/t_1 \leq 4.13$. For Examples 1 to 3, the thickness ratio $t_2/t_1$ is 2.00, which satisfies expressions (1a) and (1b).

For Example 4, Steel A (the Ni content in the Zn—Ni coating layer=12 mass %) was used for the first coated steel sheet and Steel B (the Ni content in the Zn—Ni coating layer=10 mass %) for the second coated steel sheet, and solving expressions (1a) and (1b) yield $t_2/t_1 \leq 4.13$ and $t_2/t_1 \leq 3.65$, respectively. For Example 4, the thickness ratio $t_2/t_1$ is 2.28, which satisfies expression (1a) and (1b).

In Example 5, Steel B (the Ni content in the Zn—Ni coating layer=10 mass %) was used for the first coated steel sheet and Steel C (the Ni content in the Zn—Ni coating layer=15 mass %) for the second coated steel sheet, and solving expressions (1a) and (1b) yield $t_2/t_1 \leq 3.65$ and $t_2/t_1 \leq 4.80$, respectively. For Example 5, the thickness ratio $t_2/t_1$ is 1.52, which satisfies expressions (1a) and (1b).

For Example 6, Steel C (the Ni content in the Zn—Ni coating layer=15 mass %) was used for the first coated steel sheet and Steel B (the Ni content in the Zn—Ni coating layer=10 mass %) for the second coated steel sheet, and solving expressions (1a) and (1b) yield $t_2/t_1 \leq 4.80$ and $t_2/t_1 \leq 3.65$, respectively. For Example 6, the thickness ratio $t_2/t_1$ is 2.92, which satisfies expressions (1a) and (1b).

For Example 7, Steel C (the Ni content in the Zn—Ni coating layer=15 mass %) was used for the first coated steel sheet and Steel D (the Ni content in the Zn—Ni coating layer=22 mass %) for the second coated steel sheet, and solving expressions (1a) and (1b) yield $t_2/t_1 \leq 4.80$ and $t_2/t_1 \leq 5.80$, respectively. For Example 7, the thickness ratio $t_2/t_1$ is 4.25, which satisfies expressions (1a) and (1b).

For Example 8, Steel A (the Ni content in the Zn—Ni coating layer=12 mass %) was used for the first coated steel sheet and Steel E (the Ni content in the Zn—Ni coating layer=13 mass %), and solving expression (1a) and (1b) yield $t_2/t_1 \leq 4.13$ and $t_2/t_1 \leq 4.36$, respectively. In Example 8, the thickness ratio $t_2/t_1$ is 3.78, which satisfies expressions (1a) and (1b).

In contrast, for Comparative Example 1, the press forming start temperature at the two-ply portion was higher than the solidification point (827° C.) of the Zn—Ni coating layer (the Ni content in the Zn—Ni coating layer=12 mass %) of each of the first and second coated steel sheets, and liquid metal embrittlement cracking occurred in the hot press formed part.

For Comparative Example 2, the press forming start temperature at the single-ply portion was lower than the $Ar_3$ transformation temperature (610° C.), and the hot press formed part suffered a reduction in hardness at the single-ply portion.

For Comparative Example 3, the thickness ratio was outside the appropriate range, the press forming start temperature at the two-ply portion was higher than the solidification point (850° C.) of the Zn—Ni coating layer of the first coated steel sheet, and liquid metal embrittlement cracking occurred in the hot press formed part.

For Comparative Examples 4 to 9, the coating layers were pure Zn coating layers (Comparative Examples 4, 5 and 8) or Zn—Fe coating layers (Comparative Examples 6, 7 and 9), which had lower solidification points, and in any of these cases liquid metal embrittlement cracking occurred in the hot press formed part.

Additionally, for Comparative Examples 8 and 9, the press forming start temperature at the single-ply portion was set at or below the $Ar_3$ transformation temperature of the base steel sheet of the first coated steel sheet, and in either case the hot press formed part suffered a reduction in hardness at the single-ply portion.

As described above, the present disclosure enables manufacture of high-strength, lightweight, and high-fatigue-strength hot press formed parts without causing liquid metal embrittlement cracking even when performing hot press forming on hot press forming objects having a larger thickness ratio than that of conventional ones.

REFERENCE SIGNS LIST

1 Hot press forming object
3 Two-ply portion
5 Single-ply portion
11 Tool of press forming
13 Die
15 Punch
17 Blank holder
21 Hot press formed part
23 Top portion
25 Wall portion

The invention claimed is:

1. A method for manufacturing a hot press formed part, comprising:

preparing a hot press forming object comprising a single-ply portion and a two-ply portion by welding first and second coated steel sheets together in partially overlapping relationship, each of the first and second coated steel sheets having a Zn—Ni coating layer formed on a surface thereof;

heating the hot press forming object to a temperature range from an $Ac_3$ transformation temperature of a base steel sheet of the first coated steel sheet to 1000° C.;

then, cooling the hot press forming object, then, press forming the hot press forming object to obtain a formed body, the press forming being started upon the temperatures of the single-ply portion and of the two-ply portion being no higher than solidification points of the Zn—Ni coating layers of the first and second coated steel sheets and no lower than the Ara transformation temperature of the base steel sheet of the first coated steel sheet; and quenching the formed body, while squeezing the formed body by a tool of press forming and holding at its press bottom dead center, to thereby obtain a hot press formed part, wherein the hot press forming object has a thickness ratio, expressed as $t_2/t_1$, from 1.4 to 5.0 where $t_1$ denotes a thickness in millimeters of the single-ply portion and $t_2$ denotes a thickness in millimeters of the two-ply portion, and wherein the solidification point of each of the Zn—Ni coating layers of the first and second coated steel sheets is 800° C. or higher.

2. The method for manufacturing a hot press formed part according to claim 1, wherein each of the Zn—Ni coating layers of the first and second coated steel sheets has an Ni content from 9 mass % to 25 mass %.

3. The method for manufacturing a hot press formed part according to claim 1, wherein the following relations are satisfied:

$$-0.35\times[\text{Ni }\%]_1^2+17.1\times[\text{Ni }\%]_1+72\geq 153\times\ln(t_2/t_1)+9.6;$$

and $$-0.35\times[\text{Ni }\%]_2^2+17.1\times[\text{Ni }\%]_2+72\geq 153\times\ln(t_2/t_1)+9.6,$$

where $[\text{Ni }\%]_1$ denotes the Ni content in mass % in the Zn—Ni coating layer of the first coated steel sheet and $[\text{Ni }\%]_2$ denotes the Ni content in mass % in the Zn—Ni coating layer of the second coated steel sheet.

4. A hot press formed part manufactured by the method as recited in claim 1.

5. The method for manufacturing a hot press formed part according to claim 2, wherein the following relations are satisfied:

$$-0.35\times[\text{Ni }\%]_1^2+17.1\times[\text{Ni }\%]_1+72\geq 153\times\ln(t_2/t_1)+9.6;$$

and $$-0.35\times[\text{Ni }\%]_2^2+17.1\times[\text{Ni }\%]_2+72\geq 153\times\ln(t_2/t_1)+9.6,$$

where $[\text{Ni }\%]_1$ denotes the Ni content in mass % in the Zn—Ni coating layer of the first coated steel sheet and $[\text{Ni }\%]_2$ denotes the Ni content in mass % in the Zn—Ni coating layer of the second coated steel sheet.

6. A hot press formed part manufactured by the method as recited in claim 2.

7. A hot press formed part manufactured by the method as recited in claim 3.

8. A hot press formed part manufactured by the method as recited in claim 5.

9. The method for manufacturing a hot press formed part according to claim 1, wherein the thickness ratio of the hot press forming object is more than 2.0 to 5.0.

10. The method for manufacturing a hot press formed part according to claim 2, wherein the thickness ratio of the hot press forming object is more than 2.0 to 5.0.

11. The method for manufacturing a hot press formed part according to claim 3, wherein the thickness ratio of the hot press forming object is more than 2.0 to 5.0.

12. The method for manufacturing a hot press formed part according to claim 5, wherein the thickness ratio of the hot press forming object is more than 2.0 to 5.0.

13. A hot press formed part manufactured by the method as recited in claim 9.

14. A hot press formed part manufactured by the method as recited in claim 10.

15. A hot press formed part manufactured by the method as recited in claim 11.

16. A hot press formed part manufactured by the method as recited in claim 12.

* * * * *